United States Patent [19]

Hardt

[11] 4,003,505

[45] Jan. 18, 1977

[54] RELIEF VENT FOR PRESSURIZED CANS

[75] Inventor: Jean Hardt, Benken, Switzerland

[73] Assignee: Aluminium Suisse S.A., Switzerland

[22] Filed: Dec. 23, 1975

[21] Appl. No.: 643,767

Related U.S. Application Data

[63] Continuation-in-part of Ser. No. 460,193, April 11, 1974, abandoned, which is a continuation of Ser. No. 264,964, June 21, 1972, abandoned.

[30] Foreign Application Priority Data

June 23, 1971 Switzerland ..... 9163/71
June 5, 1972 Japan ..... 47-8258

[52] U.S. Cl. ..... 222/397
[51] Int. Cl.[2] ..... B65D 83/14
[58] Field of Search ..... 220/89 A, 66, 67; 222/541, 397

[56] References Cited

UNITED STATES PATENTS

| | | | |
|---|---|---|---|
| 3,029,987 | 4/1962 | Gronemeyer | 222/397 X |
| 3,074,602 | 1/1963 | Shillady et al. | 222/397 |
| 3,244,316 | 4/1966 | Atkinson et al. | 220/89 A |
| 3,680,743 | 8/1972 | Reinnagel | 222/397 |
| 3,724,727 | 4/1973 | Zundel | 222/397 |
| 3,826,412 | 7/1974 | Kneusel | 222/397 |
| 3,831,822 | 8/1974 | Zundel | 222/397 |

*Primary Examiner*—Allen N. Knowles
*Assistant Examiner*—Norman L. Stack, Jr.
*Attorney, Agent, or Firm*—Robert E. Burns; Emmanuel J. Lobato; Bruce L. Adams

[57] ABSTRACT

An aerosol dispenser can has a cylindrical body and an outwardly-concave bottom divided into an outer annular frusto-spherical part and a central dome like part by a plurality of discrete generally tangential scores spaced apart in circular configuration, the central part having a greater radius of curvature than the outer part. Generally tangential scores may also be spaced around a rolled rim at the edge of the bottom. These scores weaken the resistance of the bottom to outward deformation so that in the case of a certain internal overpressure, the bottom firstly deforms outwardly and one or more scores then gradually rip, without propagation of the ripping, to release the overpressure. The neighboring ends of adjacent scores may be arranged out of alignment with one another to prevent propagation of ripping from one score to the next.

15 Claims, 14 Drawing Figures

FIG.1
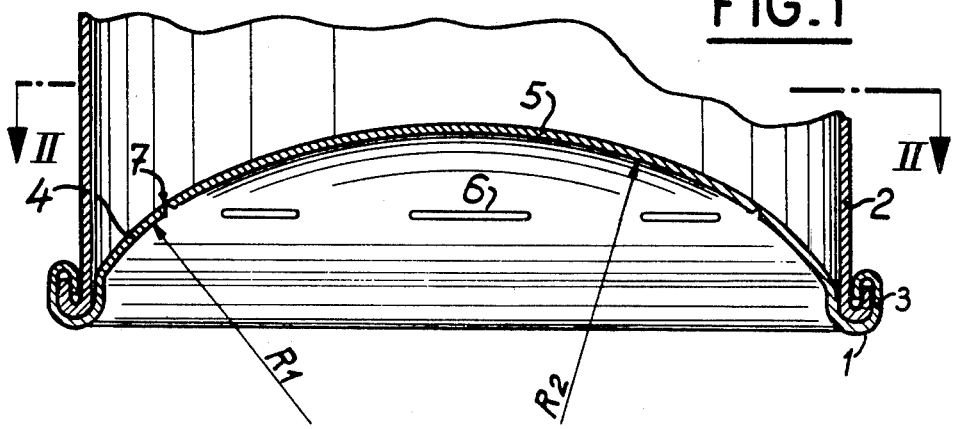
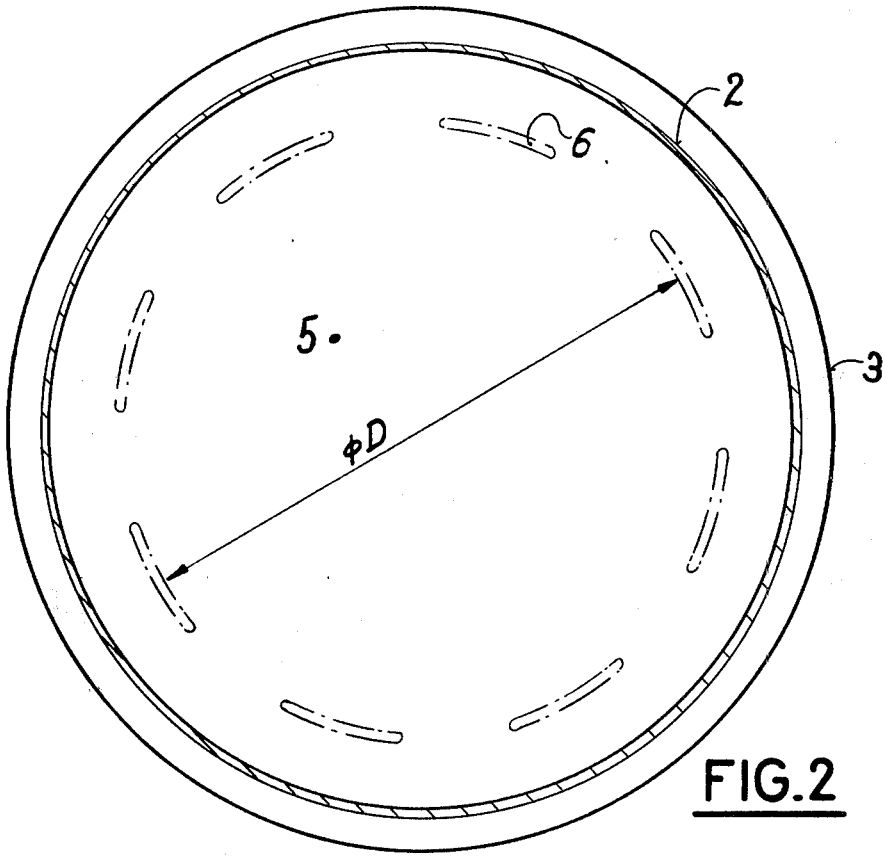
FIG.2

RELIEF VENT FOR PRESSURIZED CANS

This application is a Continuation-in-Part of application Ser. No. 460,193, filed Apr. 11, 1974, which was a Continuation of application Ser. No. 264,964, filed June 21, 1972 both now abandoned.

The invention relates to packaging cans for pressurized products, such as aerosol dispenser cans.

Aerosol dispenser cans are submitted to relatively high internal pressures. At a temperature of 20° C the pressure varies between 2.5 and 6.6 kg/cm². The pressure rises rapidly with the temperature and at a temperature of 50° C it reaches a value varying from 6 to 12 kg/cm². Such an increase in pressure involves a danger of explosion of a can.

According to the present day international regulations in force, the pressure that the can must support without visible deformation must be at least equal to 10 kg/cm², or 50% greater than the pressure in the can at a temperature of 50° C, i.e. a maximum of 18 kg/cm². The explosion pressure should be 20% greater than this value.

However, despite the setting up of regulations the risk of explosion of cans and the resulting damage still exists.

To avoid explosion, it has been proposed in West German Patent Specification (DAS) No 1192098 to provide a can with a zone of low resistance which gives way when the inner pressure exceeds a given value. Nevertheless if the zone of low resistance tears abruptly this may lead to an explosion involving a reaction effect with the can being propelled at high speed, and still forming a danger. It has also been proposed in U.S. Pat. No, 3,292,826 (Abplanalp) to provide a single circular line of weakness in the side or end wall of a can, by scoring, punching or embossing. The line of weakness was, however, preferably not included in the bottom of the can, since an abrupt discharge of pressure against the surface on which the can is seated would tend to propel the can from the surface. Nevertheless, whatever be the location of the line of weakness according to the proposal of Abplanalp, where there is an excessive inner overpressure, instead of a gradual tear to safely release the overpressure, the line of weakness is liable to abruptly tear along its entire length and burst open.

Another approach to the same problem was disclosed in U.S. Pat. No. 2,795,350 (Lapin) which proposes a single radial nick or cut (hereinafter referred to as a score) penetrating partly through a folded lower (or upper) rim. The idea here was that in the event of an increase in the internal pressure, the concave center of the bottom everts and abruptly straightens the previously folded-over rim, causing the part of the wall weakened by the score to open and release the pressure. A similar approach, disclosed in U.S. Pat. No. 3,074,602 was to provide an integral spot of weakened material in a concave dome on the can, which spot ruptures when the dome bulges to an outwardly convexed condition.

Tests on cans manufactured with a single radial score have however shown this arrangement to be unreliable. In practice, the eversion of the dished bottom does not occur uniformly from the center and then simultaneously at each part of the edge. Instead, eversion is assymetric. Eversion begins at one part of the periphery of the dished bottom and progressively propagates around the rim. Depending upon the position of the score in relation to the point at which eversion occurs, the weakened part may or may not open, even if the score is made relatively deep. A development of the Lapin system, reported in an article entitled "Putting the Pressure on Aerosol Safety" in Modern Packaging, February 1973, and also disclosed in U.K. Patent Specification No. 1,325,964, published August 1973, was to increase the number of radial scores, which are placed around a rolled seam on a dome. But the provision of relatively deep radial scores with great uniformity around the rolled seam presents a serious manufacturing challenge and the acknowledged failure rate is as high as 10% (U.K. Patent Specification No. 1,325,964, page 4, lines 55–61).

Hence, although the scoring technique originated by Lapin has been known for many years, it has not yet found favor on a large commercial scale because of the practical difficulties involved in scoring, but the tendency has been to avoid scoring techniques and most development efforts have been directed to other systems, particularly mechanical release devices involving the valve, and also various plugging systems and puncturing devices.

An object of the invention is to provide an aerosol dispenser or similar can having a zone of low resistance with controlled and limited tearing and which satisfied the regulations in force, tearing (i.e. opening) only take place after an end closure (concave bottom or dome) of the can has been outwardly deformed.

According to the invention a packaging can for pressurized products such as aerosols comprises a tubular body having closed opposite ends, one of said ends having a dished portion dished inwardly toward the interior of said tubular body and having a generally circular central area deformable outwardly in an axial direction when a predetermined internal pressure is exceeded in said body. Said end has a multiplicity of elongated discrete scores corresponding to tearable areas of reduced cross section of a material defining said end, said scores each having a major length component disposed tangential to the boundary of said circular central area and said material being weakened in said areas of reduced cross section and enabled to progressively tear when the central area is deformed outwardly. Said scores are disposed in a circular configuration spaced from each other in a circumferential direction in said circular configuration with end portions thereof in positions to avoid propagation of tearing from one score to another and each have a length of major component thereof to facilitate outward deforming of said circular central area. In this manner, when said predetermined internal pressure is exceeded, said central area deforms outwardly and at least one of said areas of reduced cross section progressively tears without propagation of tears between the areas and without rupture of said central area thereby relieving the internal pressure progressively. Such progressive release may take place during several tenths of a second, for example up to half a second or even longer, even a period of minutes if heating of the can is very slow. This is considerably longer than the corresponding time of release in the event of an explosion, which would be of the order of 1/1000 to 1/100 of a second.

The said scores may be in the form of arcuate portions of a circle all lying spaced-apart around the same circle with the facing end portions of adjacent scores all lying substantially in alignment with one another, but spaced apart so that the ripping of one score will not extend through the non-cut zone into the following score, and so on one by one, but one or more scores may each individually tear to gradually release the internal pressure.

According to certain embodiments of the invention, in order to prevent propagation from one score to the next, elongate scores are arranged with the neighbouring end portions of adjacent scores out of alignment with one another. In this manner the ripping is directed into the body of the metal where its propagation is attenuated and blocked.

In practice, substantially straight scores may be disposed obliquely in relation to tangents of a circle defining their general configuration, or disposed alternately inside and outside said circle. The scores may include a substantially rectilinear central portions out of alignment with the central portion, either substantially in the shape of a flattened U or an elongated S.

The circular zone weakened by the scores as provided by the invention to facilitate outward deformation of said circular central area should not in any way be confused with rupture disc arrangements provided in known high pressure applications where a weakness is provided to ensure complete rupture of a central disc zone. In fact, the purpose of the invention is precisely to avoid any complete rupture which, in an aerosol dispenser can, would involve an abrupt pressure release with the aforementioned propulsion effect. In an aerosol can according to the invention, the provision of generally tangential scores in circular configuration reduces the resistance to outward deformation of the central part, this outward deformation producing a weakening, by folding thereof, of the work-hardened areas of reduced cross-section to a greater degree than the unscored parts, so that the scores may individually tear without a risk of propagation of ripping and hence explosion.

Further, as noted above, outward deformation, e.g. by eversion or axial sliding, of said central area takes place assymetrically, i.e. it starts at one point of the boundary of said central area and then progressively circumferentially propagates around said boundary. Consequently, said outward deformation, in addition to the folding which weakens said areas, will involve a shearing action along the major tangential component of the weakened areas which contributes to ripping thereof. This hence enhances the effectiveness and reliability of correct functioning of the safety venting arrangement, since it enables, compared to the known proposal with a radial score, a reduction of the effective score depth and hence enlarges the manufacturing tolerance of scoring.

In a preferred embodiment of the invention said end is secured to the can body by a folded annular bead in which the scores are arranged. The folded annular bead may be connected to the central dished portion by a cylindrical skirt, said dished portion having a greater resistance to eversion than does said skirt to an axial outward displacement involving a progressive rolling of said skirt corresponding to unrolling of said annular bead. In this manner, when said predetermined pressure is exceeded, said skirt is displaced axially outwardly and said bead is at least partially unrolled to open at least one score without eversion of said dished portion. Alternatively, the arrangement may be such as to provide for opening of one or more scores only after an eversion or buckling out of the dished portion.

Embodiments of the invention will now be particularly described, by way of example, with reference to the accompanying drawings, in which:

FIG. 1 is a cross-sectional view of the bottom part of a first embodiment of an aerosol can;

FIG. 2 is a schematic view of the bottom of the can, in cross-section along line II—II of FIG. 1;

Figure 6:
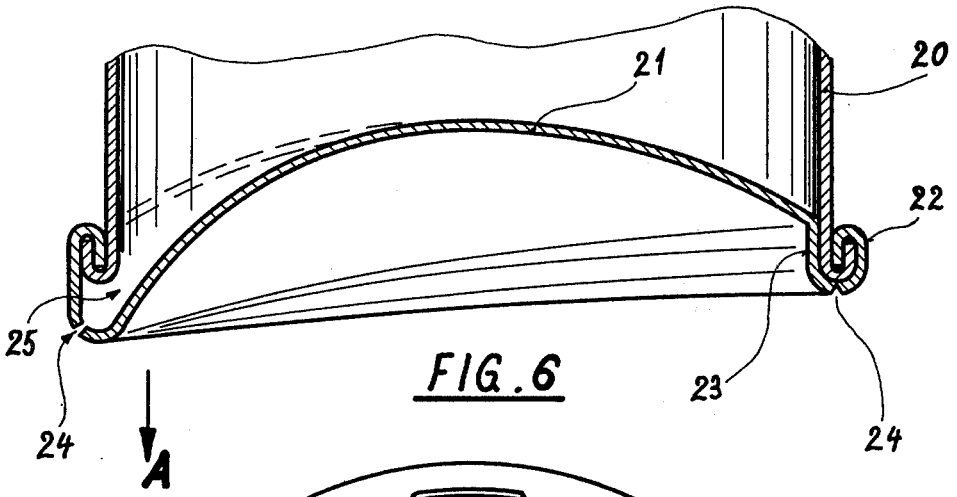
Figure 7:
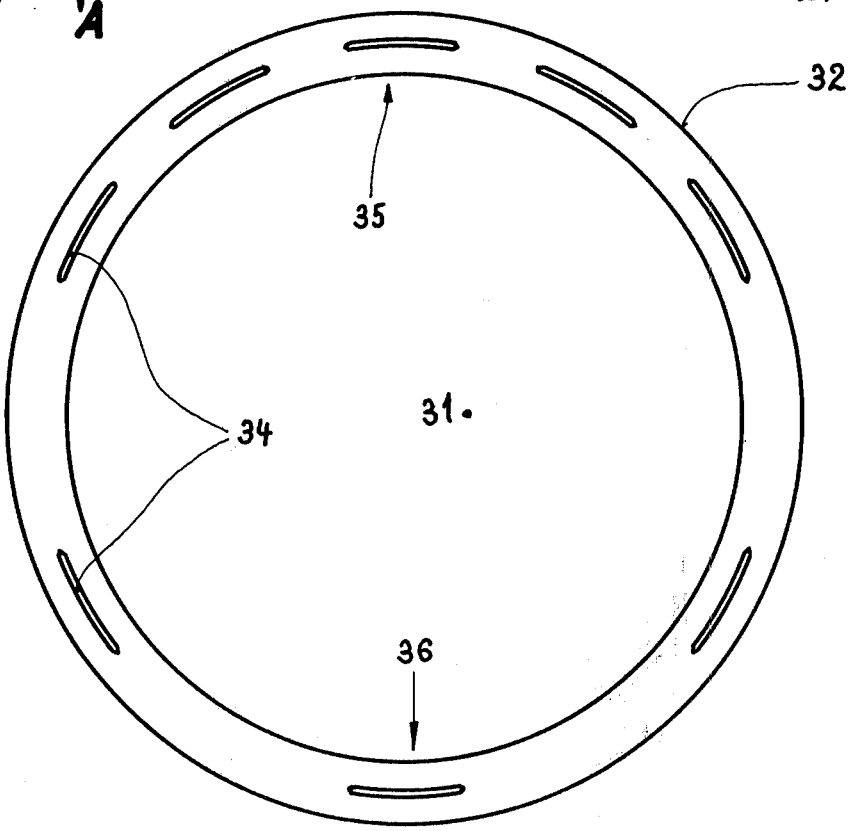
Figure 8:
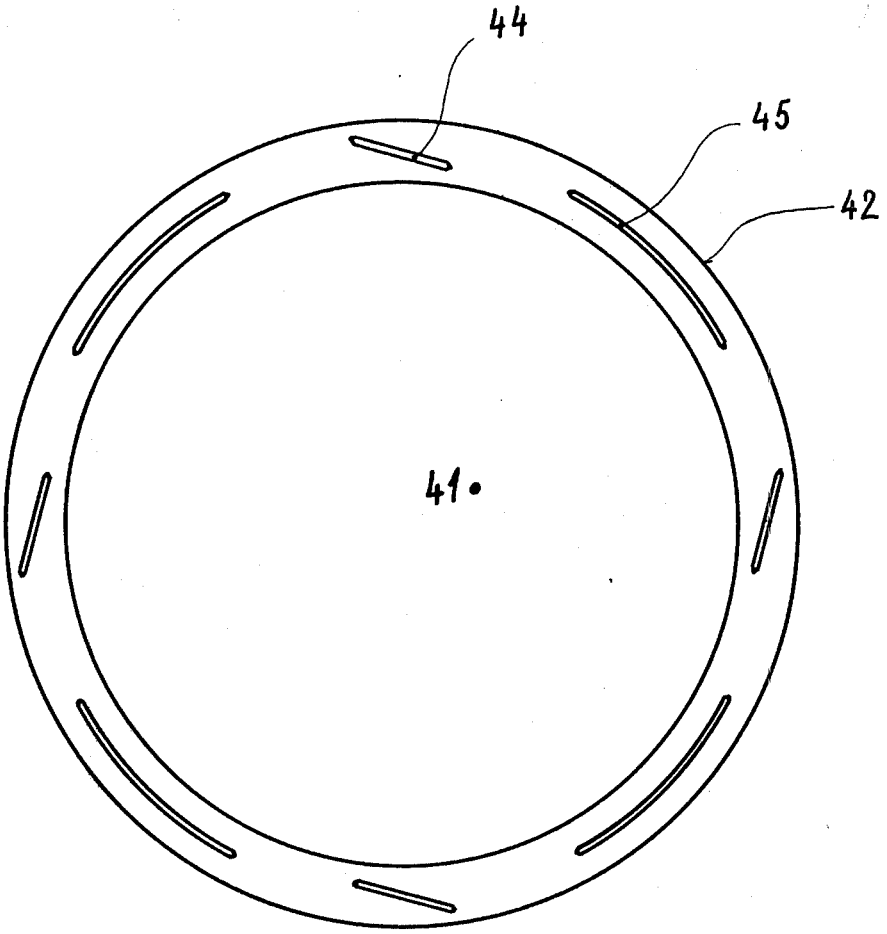

FIGS. 5*a*, *b*, *c*, *d*, *e*, *f* and *g* show various possible dispositions of scores;

FIG. 6 is a cross-sectional view of a bottom part of a can after deformation; and FIGS. 7 and 8 are schematic underneath plan views showing special score patterns for cans of the type shown in FIG. 6.

FIGS. 1 and 2 show the bottom of an aerosol can having an outwardly directed concavity and fixed by a rolled edge 1 to a cylindrical can body 2 which has at its base an annular bulge 3, edge 1 and bulge 3 forming an annular bead.

The bottom has two parts of different curvature, an annular trunco-spherical part 4 with a radius of curvature R1 and a central domelike part 5 with a radius of curvature R2, R2 being greater than R1. Along the circle junction of these two parts are a plurality of discrete scores 6 disposed tangentially in circular configuration. Scores 6 are preferably produced by impact using a special punch. The scores 6 are equi-spaced apart from one another to define a circular zone of weakness which facilitates eversion while propagation of ripping from one score to the next is attenuated. Eversion of the central part 5 produced by an overpressure in the can involves a folding of the material of the bottom along said circular zone of weakness. This involves a weakening of the material in the parts of reduced cross-section corresponding to the locations of scores 6, because the impact scoring operation hardens the metal in these regions and makes it more brittle. During the folding, these brittle scored parts are further worked and become even more brittle. The depth of the scores 6 is such that after this weakening by folding, one or more of the areas corresponding to the scores 6 will individually tear and safely vent the excess pressure. The scores 6 preferably have a triangular cross-section as shown at 7. Tearing along the part weakened by a score is preceded by a deformation of the bottom which involves a closing-up of the triangular section of the score, the two edges of each score coming to bear against one another, and the part of reduced cross-section corresponding to the bottom of the score then gradually ripping under the effect of traction and a shearing action as described below. The relatively strong areas between the adjacent scores are not work-hardened by the scoring operation, so that they are relatively more plastically deformable and hence are far less stressed by said folding than the scored areas and hence are not appreciably weakened by said folding. Any tendency for the ripping along one scored area to propagate to the adjacent scored areas is therefore opposed.

Since ripping of a scored part can only occur after a flexion therein to weaken the material at these locations, the bottom is arranged, in the case of an overpressure, so that the central part 5 will deform and buckle out before the peripheral part 4. In order to fulfil this condition, the resistance of the central part 5 is arranged to be lower than that of the peripheral part 4. Now, the greater the radius of curvature R2 the smaller is the resistance of the central part 5, and the smaller the diameter D of the circle about which scores 6 are arranged the greater is the resistance of the central part. The radius of curvature R2 is consequently made greater than the radius of curvature R1, otherwise the bottom would risk deforming in another manner. By varying the thickness of the material, the radii R1 and R2 as well as the diameter D, it is possible to provide a bottom resisting a given maximum pressure and in which the central part 5 deforms outwardly in the case of a certain internal overpressure prior to ripping of the incisions 6.

Outward bucking or eversion of the central part 5 does not, however, occur simultaneously at each point around the line weakened by scores 6. Instead, eversion begins at one point on said line and then propagates around this line. Consequently, during eversion, in addition to a transverse folding, the lines weakened by the scores also undergo a shearing action along their length, and this is an important factor in ensuring the reliability of the safety-venting function.

As a variation of the first embodiment, the bottom could be made in one piece with the side wall of the can, for example in aluminium.

Figure 3:
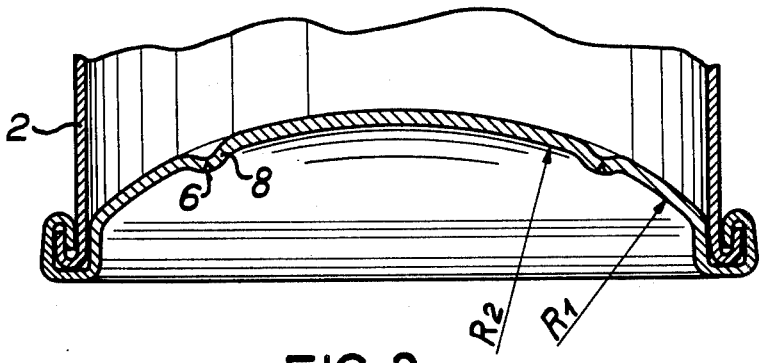
FIGS. 3 and 4 are cross-sectional views of the bottom parts of second and third embodiments of aerosol can.

In the embodiment shown in FIG. 3, two zones of different radii of curvature R1 and R2 are also provided on the bottom of a can, R2 being greater than R1. However, in this embodiment scores 6 are located in an intermediate zone formed by an undulation in the form of an annular embossment 8. This embossment has a manufacturing advantage over the first embodiment, since it enables the scores to be simultaneously made during stamping of the bottom with a lesser risk of causing a ripping of the bottom under the effect of radial traction thereon during stamping. Moreover, the material in the embossment 8 is harder, and eversion of the central part involves a greater flexion along the line weakened by scores 6.

Figure 4:
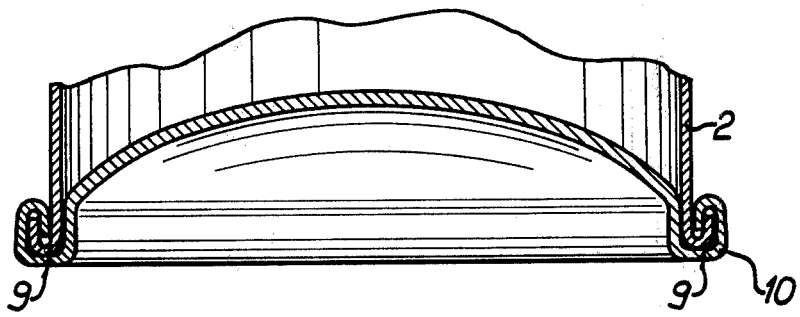

In the embodiment shown in FIG. 4, tangential scores 9 are provided spaced-apart from one another around an annular bead 10 of the edge of the bottom where it is secured to the can body 2. This embodiment is thus only applicable to fitted bottoms. It requires a supplementary operation since the scores cannot be made during stamping of the bottom, but on the other hand it has the advantage of enabling a greater deformation of the concave bottom and of not having any effect on the inner protective coating of the bottom, generally formed by a lacquer, even if the scores were made by stamping a previously lacquered bottom.

Moreover, the scores may alternatively be provided on an added valve-supporting dome at the upper end of the can, for example adjacent to an annular bead by which the dome is secured to a cylindrical can body.

Figure 5:
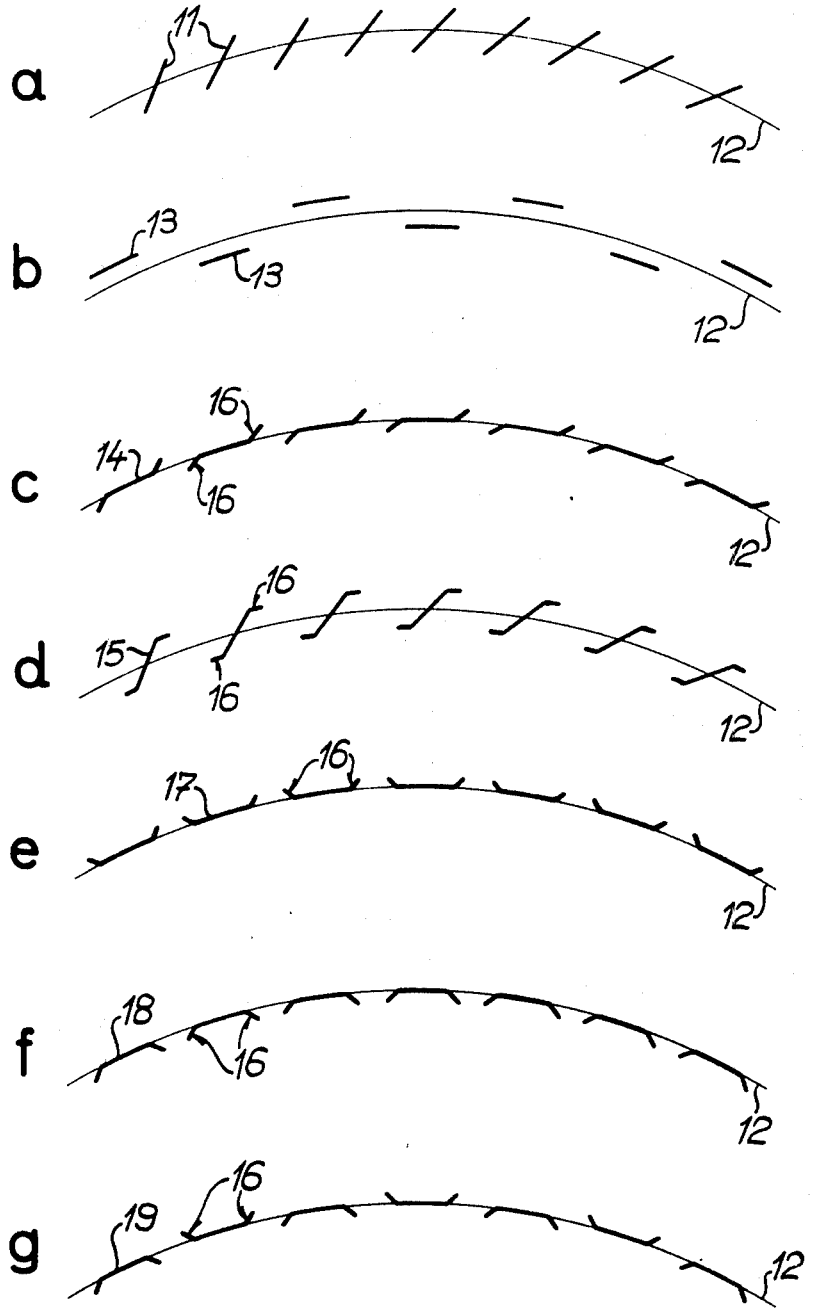

In FIGS. 1 to 4, the scores 6 are in the form of arcuate portions arranged in line around the same circle. FIG. 5 shows various embodiments of different shapes and disposition of scores, for which the neighboring ends of adjacent scores are out of alignment with one another, which enhances attenuation of propagation of ripping from one scored part to the next.

In FIG. *a*, equally spaced-apart rectilinear scores 11 are disposed obliquely in relation to tangents of a basic circle 12 defining the general configuration of the scores.

In FIG. *b*, rectilinear scores 13 are located alternately on either side of the basic circle 12.

In FIGS. *c* and *d*, elongated scores 14 and 15 each have a substantially rectilinear central part and ends disposed obliquely thereto in opposite directions. The central parts of the scores are disposed tangentially to the basic circle 12 in FIG. *c*, and obliquely in relation to tangents of the basic circle 12 in FIG. *d*, with the ends substantially parallel to corresponding tangents of the circle.

In FIGS. *e*, *f*, and *g*, scores 17, 18 and 19 have a substantially rectilinear central part and ends 16 disposed obliquely thereto in the same direction, substantially in the shape of a flattened U. In FIG. *e*, all of the ends of the U-shaped scores are turned in the same direction, towards the exterior of the basic circle 12, whilst in FIG. *f*, the ends of the scores are all turned towards the interior of the circle. In FIG. *g*, the ends 16 are alternately turned towards the interior and towards the exterior of the basic circle 12.

FIG. 6 shows a can of the type shown in FIG. 4, after deformation and safety venting by opening of one or more scores, the original undeformed state of the can being indicated in a dashed line. The can of FIG. 6 comprises a cylindrical side wall 20 with a dished bottom 21 united by a rolled seam 22 including an internal rubber lining not shown. Between its folded external part incorporated in seam 22 and its dished central part, the bottom 21 has a cylindrical skirt 23 against the inner surface of wall 20. Prior to rolling of the seam 22, the peripheral part of bottom 21 is stamped with a number of tangential or substantially tangential scores 24 in circular configuration so that after rolling the seam, scores 24 are on the round lower edge of seam 22, as shown in the right-hand part of FIG. 6. Wall 20 and bottom 21 are for example in aluminum, and the dished part of bottom 21 has a radius of curvature such that it has a greater resistance to eversion due to an overpressure in the can than does the rolled seam 22 to unrolling involving an axial downward displacement and progressive rolling of skirt 23.

Consequently, when an overpressure is produced in the can, a part of the bottom 21 will begin to move outwardly as indicated by arrow A, this movement tending to propagate circumferentially around the periphery of the bottom. However, as the skirt 23 rolls, the areas weakened by scores 24 fold and are subjected to a combined action of bending, shearing and tension so that one or more of the scored areas 24' will rip open and vent the overpressure, the downward deformation of skirt 23 being such as to form a passageway 25 which communicates these scores 24' with the interior of the can. As soon as this happens, the internal pressure drops and outward deformation of bottom 21 ceases, so that in practice the deformation does not propagate right the way around the can, but a part of seam 22 remains intact.

Several cans of the FIG. 6 type were produced according to the following specification:

material: aluminium, (tensile strength 25 kp/mm2)
nominal diameter: 59 mm
wall thickness: 0.42 – 0.44 mm
score depth: 0.26 mm (62%)
score length: 8 mm
number and orientation of scores: 6, 8, 12 and 18 all tangential, 6 and 18 at 15° to tangential The cans were tested by subjecting to abrupt liquid pressure in an apparatus adapted for this purpose. All cans functioned correctly, i.e. vented the pressure by opening of one or more scores after a sliding of the bottom.

The same tests were repeated with some cans scored with a punch which had been sanded to simulate wear, and all gave an identical result.

By way of comparison, a series of cans with a single radial score 3 mm long (maximum convenient length) and a depth of 0.26 mm (62%) gave the following results:

9 cans, bottom ripped off;

1 can vented after buckling out (eversion) of the bottom.

Using tin-plate as the material of the cans, (tensile strength = 40 kp/mm2), thickness 0.38 – 0.39 mm, satisfactory results were obtained with 12 – 18 tangential scores, or at 15° to tangential, with a depth of 0.26 mm (68%). Similar tin-plate cans with a single radial score all failed to vent, but the bottoms were all ripped off.

Although cans according to FIG. 6 have functioned satisfactorily with tangential scores, the arrangement with scores at an angle, for example 10° or 15°, to tangential is preferred since, in addition to the reduced risk of propagation of ripping from one score to the next, it enables the seam rolling operation to be carried out with greater tolerances since with exactly tangential scores a slight variation in rolling can cause incorrect placing of the scores on the rolled seam.

As an alternative to the described arrangement of FIG. 6, it is possible to suitably choose the material and configuration of the bottom (in particular the radius of the dished part), so that the dished part will at least partially evert or buckle out before one or more of the scores rip open.

With reference now to FIG. 7, there is shown a dished can bottom 31 with an assymetric score pattern in a rolled seam 32. This circular score pattern consists of tangential scores 34, four of which are relatively close to one another in a first arcuate zone 35, and the remaining three of which are spaced relatively further apart around a second arcuate zone 36. The greater tangential extent of scores 34 in zone 35 substantially reduces the resistance of this part of the periphery to outward deformation when an excessive pressure is applied to the dished bottom 31. Consequently, outward deformation of the periphery of bottom 21 will commence in zone 35 and tend to propagate around the remainder of the periphery, until one (at least) of the scored areas opens. Normally, this will be one of the scored areas in zone 35, so that the outward deformation of bottom 31 will not propagate right the way round the can bottom. The scores 34 in zone 36 serve to reduce the overall resistance of the bottom 31 to outward deformation and form a safety factor in case the other scores should fail.

FIG. 8 shows a dished can bottom 41 having a rolled seam 42 with a circular score pattern formed by scores 44 and 45. The four scores 44, having an inclination of approximately 15° to tangential, have a depth such that when the bottom 41 is deformed outwardly, the scores 44 are weakened to such an extent that they are liable to rip open. This depth may for example be 55–60% for aluminium or 65–70% for tin. The scores 44 are separated by relatively long and shallow arcuate scores 45. The depth of scores 45, for example 25–30% for aluminium or 30–35% for tin plate, is such that these scores reduce the resistance of bottom 41 to outward deformation, but when the bottom 41 deforms outwardly, the corresponding scored parts remain strong enough not to rip. The inclination of scores 44 and their spacing from the shallow scores 45 avoids the propagation of ripping to the shallow scored parts.

What is claimed is:

1. A packaging can for pressurized products such as aerosols, comprising a tubular body having closed opposite ends, one of said ends having a dished portion dished inwardly toward the interior of said tubular body and having a generally circular central area deformable outwardly in an axial direction when a predetermined internal pressure is exceeded in said body, said end having a multiplicity of elongated discrete scores corresponding to tearable areas of reduced cross section of a material defining said end, said scores each having a major length component intermediate opposite end portions disposed tangential to the boundary of said circular central area and said material being weakened in said areas of reduced cross section and enabled to progressively tear when the central area is deformed outwardly, said scores being disposed in a circular configuration spaced from each other in a circumferential direction in said circular configuration with the end portions thereof in positions to avoid propagation of tearing from one score to another and each having a length of major component thereof to facilitate outward deforming of said circular central area, whereby when said predetermined internal pressure is exceeded said central area deforms outwardly and at least one of said areas of reduced cross section progressively tears without propagation of tears between the areas and without rupture of said central area thereby relieving the internal pressure progressively.

2. A packaging can according to claim 1, in which said scores are arranged concentric with a longitudinal axis of said can.

3. A packaging can according to claim 1, in which said central portion has a greater radius of curvature than a remaining peripheral part of said dished portion thereby to evert when deforming outwardly.

4. A packaging can according to claim 1, in which said scores are disposed alternately inside and outside of a circle generally defining the circular configuration of their disposition, and generally parallel to corresponding tangents to said circle.

5. A packaging can according to claim 1, in which said scores are disposed obliquely relative to tangents of a circle defining generally the circular configuration of their disposition.

6. A packaging can according to claim 1, in which each score has a substantially rectilinear central portion and opposite end portions offset relative to said central portion thereof

7. A packaging can according to claim 6, in which said end portions of each score are offset on the same side of said central portion whereby each score has substantially the shape of a flattened U, said central portions being disposed tangentially to a circle defining generally circular configuration of said scores.

8. A packaging can according to claim 6, in which said end portions of each score are offset on opposite sides of said central portion whereby each score has substantially the shape of an elongated S.

9. A packaging can according to claim 1, in which said end has a folded annular bead securing it to said body, said scores being arranged in said folded annular bead.

10. A packaging can according to claim 9, in which said folded annular bead is connected to said dished portion by a cylindrical skirt, said central area being arranged with said dished portion having a greater resistance to eversion than does said skirt to an axial outward displacement involving a progressive rolling of said skirt corresponding to unrolling of said annular bead, whereby when said predetermined pressure is exceeded said skirt is displaced axially outwardly and said bead is at least partially unrolled to open at least one score without eversion of said dished portion.

11. A packaging can according to claim 1, in which said scores are all alike and uniformly spaced apart from one another in said circular configuration.

12. A packaging can for pressurized products such as aerosols, comprising a tubular body having closed opposite ends, one of said ends having a dished portion dished inwardly toward the interior of said tubular body and having a generally circular central area deformable outwardly in an axial direction when a predetermined internal pressure is exceeded in said body, starting from one part of the boundary of said central area and with a progressive circumferential propagation of the outward deformation around said boundary, said end having a multiplicity of elongated discrete scores corresponding to tearable areas of reduced cross section of a material defining said end, said scores each having a major length component intermediate opposite end portions disposed tangential to the boundary of said circular central area and said material being weakened in said areas of reduced cross section by transverse folding of said material about said major length component and longitudinal shearing along said major length component and enabled to progressively tear when the central area is deformed outwardly, said scores being disposed in a circular configuration spaced from each other in a circumferential direction in said circular configuration with the end portions thereof in positions to avoid propagation of tearing from one score to another and each having a length of major component thereof to facilitate outward deforming of said circular central area, whereby when said predetermined internal pressure is exceeded said central area deforms outwardly and at least one of said areas of reduced cross section progressively tears without propagation of tears between the areas and without rupture of said central area thereby relieving the internal pressure progressively.

13. A packaging can according to claim 12, in which said scores are non-uniformly arranged in said circular configuration to provide one part of said boundary with a lesser resistance to said outward deformation than the remainder of said boundary thereby to ensure that said outward deformation starts at said one part and progressively circumferentially propogates around at least a part of the remainder of said boundary.

14. A packaging can for pressurized products such as aerosols comprising a tubular body having closed opposite ends, one of said ends having a dished portion dished inwardly toward the interior of said tubular body and having a generally circular central area deformable outwardly in an axial direction when a predetermined internal pressure is exceeded in said body, said end having a multiplicity of elongated discrete scores corresponding to areas of reduced cross section of a material defining said end, said scores each having a major length component intermediate opposite end portions disposed tangential to the boundary of said circular central area and said material being weakened in all of said areas of reduced cross section to facilitate outward deforming of said circular central area, said material being weakened in some of said areas of reduced cross-section to define tearable areas which are able to tear when the central area is deformed outwardly, said scores being disposed in a circular configuration spaced from each other in a circumferential direction in said circular configuration with the end portions thereof in positions to avoid propagation of tearing from one score to another, whereby when said predetermined internal pressure is exceeded said central area deforms outwardly and at least one of said tearable areas of reduced cross section progressively tears without propagation of tears between the areas and without rupture of said central area thereby relieving the internal pressure progressively.

15. A packaging can for pressurized products such as aerosols, comprising a tubular body having closed opposite ends, one of said ends having a dished portion dished inwardly toward the interior of said tubular body and having a generally circular central area deformable outwardly in an axial direction when a predetermined internal pressure is exceeded in said body, starting from one part of the boundary of said central area and with a progressive circumferential propagation of the outward deformation around said boundary, said end having a multiplicity of elongated discrete scores corresponding to areas of reduced cross section of a material defining said end, said scores each having a major length component intermediate opposite end portions disposed tangential to the boundary of said circular central area and said material being weakened in all of said areas of reduced cross section to facilitate said outward deformation of said circular central area by transverse folding of said material about said major length component, said material being weakened in some of said areas of reduced crosssection to define tearable areas which are subjected to longitudinal shearing along said major length component and are able to tear when the central area is deformed outwardly, said scores being disposed in a circular configuration spaced from each other in a circumferential direction in said circular configuration with the end portions thereof in positions to avoid propagation of tearing from one score to another, whereby when said predetermined internal pressure is exceeded said central area deforms outwardly and said deformation propagates circumferentially around said boundary until at least one of said tearable areas of reduced cross section tears without propagation of tears between the areas and without rupture of said central area thereby relieving the internal pressure progressively.

* * * * *